US007726443B2

(12) United States Patent
Miyazawa et al.

(10) Patent No.: US 7,726,443 B2
(45) Date of Patent: Jun. 1, 2010

(54) MUFFLER AND WORKING MACHINE

(75) Inventors: Koue Miyazawa, Kawagoe (JP); Naomi Mizuno, Kawagoe (JP)

(73) Assignee: Husovarna Zenoah Co., Ltd., Kawagoe-Shi (JP)

( * ) Notice: Subject to any disclaimer, the term of this patent is extended or adjusted under 35 U.S.C. 154(b) by 0 days.

(21) Appl. No.: 12/223,948

(22) PCT Filed: Feb. 15, 2007

(86) PCT No.: PCT/JP2007/052751

§ 371 (c)(1),
(2), (4) Date: Aug. 13, 2008

(87) PCT Pub. No.: WO2007/094419

PCT Pub. Date: Aug. 23, 2007

(65) Prior Publication Data

US 2009/0084626 A1 Apr. 2, 2009

(30) Foreign Application Priority Data

Feb. 15, 2006 (JP) ..... 2006-038607

(51) Int. Cl.

| | |
|---|---|
| ***F01N 13/08*** | (2010.01) |
| ***F01N 3/02*** | (2006.01) |
| *F01N 13/18* | (2010.01) |
| *F01N 13/00* | (2010.01) |

(52) U.S. Cl. ..... 181/240; 181/231

(58) Field of Classification Search ..... 181/240, 181/231, 230, 227, 264, 243, 258, 257, 268, 181/269, 275, 251

See application file for complete search history.

(56) References Cited

U.S. PATENT DOCUMENTS

| | | | | | |
|---|---|---|---|---|---|
| 1,532,473 | A | * | 4/1925 | Byrne | 239/288 |
| 1,867,273 | A | * | 7/1932 | Lemmerman | 181/243 |
| 2,112,534 | A | * | 3/1938 | Keen | 239/418 |
| 3,168,936 | A | * | 2/1965 | Gordon | 181/269 |
| 3,404,749 | A | * | 10/1968 | Miller et al. | 181/240 |
| 3,677,364 | A | * | 7/1972 | Pawlina | 181/269 |
| 3,863,734 | A | * | 2/1975 | Pawlina | 181/264 |

(Continued)

FOREIGN PATENT DOCUMENTS

GB 2056563 A * 3/1981

(Continued)

OTHER PUBLICATIONS

International Preliminary Report on Patentability, Chapter I of the Patent Cooperation Treaty,and Written Opinion for PCT/JP2007/052751 dated Aug. 19, 2008. 5 sheets.

*Primary Examiner*—Edgardo San Martin
(74) *Attorney, Agent, or Firm*—Frishauf, Holtz, Goodman & Chick, P.C.

(57) ABSTRACT

A muffler of a work machine in the form of an engine blower includes: a muffler body; and a diffuser that covers an exhaust outlet of exhaust gas provided on the muffler body. The diffuser has a diffusion space to diffuse the exhaust gas and an exhaust surface on which a plurality of exhaust circular holes are provided to exhaust the exhaust gas to an outside. An opening ratio provided by the exhaust holes of the exhaust surface is gradually increased from a portion corresponding to the exhaust opening toward an outer periphery of the exhaust surface.

20 Claims, 6 Drawing Sheets

U.S. PATENT DOCUMENTS

| | | | | | |
|---|---|---|---|---|---|
| 4,135,602 | A * | 1/1979 | Clark | 181/230 |
| 4,324,314 | A * | 4/1982 | Beach et al. | 181/230 |
| 4,474,260 | A * | 10/1984 | Valentine | 181/230 |
| 4,507,917 | A * | 4/1985 | Kandler | 60/323 |
| 5,177,962 | A * | 1/1993 | Hall et al. | 60/311 |
| 5,883,342 | A * | 3/1999 | Wolpert | 181/230 |
| 5,909,016 | A * | 6/1999 | Sterling | 181/230 |
| 6,010,549 | A * | 1/2000 | Higashi et al. | 55/385.3 |
| 6,209,678 | B1 * | 4/2001 | Sterling | 181/230 |
| 6,393,835 | B1 | 5/2002 | Stoll et al. | |
| 6,751,952 | B2 * | 6/2004 | Chen | 60/407 |
| 6,926,117 | B2 * | 8/2005 | Sterling | 181/230 |
| 7,073,534 | B2 * | 7/2006 | Sawchuk et al. | 138/39 |
| 7,341,173 | B1 * | 3/2008 | Arnold | 227/120 |
| 7,530,427 | B2 * | 5/2009 | Feist et al. | 181/256 |
| 7,530,428 | B2 * | 5/2009 | Feist et al. | 181/264 |
| 2008/0099277 | A1 * | 5/2008 | Liu et al. | 181/230 |

FOREIGN PATENT DOCUMENTS

| | | | |
|---|---|---|---|
| JP | 52-114838 | | 9/1977 |
| JP | 57-45372 | Y2 | 10/1982 |
| JP | 3136130 | B2 | 1/2000 |
| JP | 2001-050047 | A | 2/2001 |
| JP | 2002-522685 | A | 7/2002 |

* cited by examiner

MUFFLER AND WORKING MACHINE

TECHNICAL FIELD

This application is a U.S. National Phase Application under 35 USC 371 of International Application PCT/JP2007/052751 filed Feb. 15, 2007.

The present invention relates to a muffler for an engine and a work machine provided with the same.

BACKGROUND ART

A brushcutter, an engine blower, and a chain saw have been conventionally known as a portable work machine driven by an engine. The engine of such a work machine is driven at a position relatively close to an operator, and may be subjected to environmental regulations on a temperature of exhaust gas from a muffler. Therefore, it has been requested to exhaust the exhaust gas at a low temperature. Specifically, the temperature of the exhaust gas from an engine cover that covers the engine and the muffler is regulated.

As a method for lowering the temperature of the exhaust gas from an exhaust opening of the engine cover, for instance, it has been known that the exhaust gas is diffused and exhausted from an exhaust outlet of the muffler itself and a distance between the exhaust outlet of the muffler and the exhaust opening of the engine cover is lengthened to lower the temperature until the exhaust gas is exhausted from the exhaust opening (for example, see Patent Document 1).

[Patent Document 1] JP-A-2001-50047

DISCLOSURE OF THE INVENTION

Problems to be Solved by the Invention

The Patent Document 1 discloses that the exhaust outlet of the muffler is positioned toward an inner surface of the engine cover to lengthen the distance between the exhaust outlet of the muffler and the exhaust opening of the engine cover, and an exhaust cap that forcibly change a flowing direction of the exhaust gas is provided at the exhaust outlet to run the exhaust gas along the inner surface of the engine cover, so that the exhaust gas is exhausted from the exhaust opening. Consequently, a large space has been required to accommodate the exhaust cap between the exhaust outlet of the muffler and the inner surface of the engine cover, which has increased the size of the work machine.

An object of the present invention is to provide a muffler and a work machine provided with the same capable of lowering the temperature of the exhaust gas and downsizing the work machine by removing excessive space.

Means for Solving the Problems

A muffler according to an aspect of the invention includes a muffler body and a diffuser that covers an exhaust outlet of exhaust gas provided on the muffler body, in which the diffuser includes a diffusion space to diffuse the exhaust gas and an exhaust surface on which a plurality of exhaust holes for exhausting the diffused exhaust gas are formed, the exhaust surface facing the exhaust outlet, and an opening rate provided by the exhaust holes of the exhaust surface is gradually increased toward an outer periphery of the exhaust surface from a portion corresponding to the exhaust outlet.

In the diffusion space according to the aspect of the invention, exhaust resistance (i.e. internal pressure) at the outer peripheral side is reduced in accordance with the setting of the opening rate provided by the exhaust holes formed on the exhaust surface. Accordingly, the exhaust gas is evenly diffused toward the outer peripheral side and evenly exhausted from the respective exhaust holes, whereby the temperature of the exhaust gas is effectively lowered. In addition, the exhaust outlet of the muffler body is provided at a rectilinear position corresponding to the exhaust opening of the engine cover since the temperature of the exhaust gas can be effectively lowered. Consequently, an extra space is not necessary in the work machine.

A total area of the exhaust holes may be smaller than an opening area of the exhaust outlet.

With this arrangement, the exhaust resistance is ensured so that the exhaust gas is effectively diffused toward the outer peripheral side in the diffusion space.

It is preferable that the plurality of exhaust holes are provided as a plurality of kinds of exhaust holes respectively having a different opening area. Some of the plurality of exhaust holes having small opening areas may be arranged adjacent to a portion corresponding to the exhaust outlet and the other of the plurality of exhaust holes having large opening areas may be arranged adjacent to the outer periphery.

With this arrangement, the internal pressure is reliably reduced at the outer peripheral side to be smoothly leaked since the opening area of the respective exhaust holes at the outer peripheral side is large, whereby the exhaust gas is further effectively diffused toward the outer peripheral side.

It is preferable that the diffuser is provided with a flange to be attached to the muffler body, and the flange is inclined toward a front side in an attachment direction before the diffuser is attached to the muffler body.

For example, when screws and the like are used to attach the diffuser, the flange is pushed back to a base end side in the attachment direction, which generates elastic force (reaction force). The diffuser is appropriately attached to the muffler body by the elastic force (reaction force), thereby effectively preventing the exhaust gas in the diffusion space from leak from the attachment portion.

A work machine according to another aspect of the invention includes the muffler as described above, an engine to which the muffler is attached, and the engine cover is provided with an exhaust opening at a position corresponding to the exhaust outlet of the muffler to exhaust the exhaust gas to an outside.

EXPLANATION OF CODES

Best Mode for Carrying Out the Invention

An exemplary embodiment of the invention will be described below with reference to the drawings.

Figure 1:
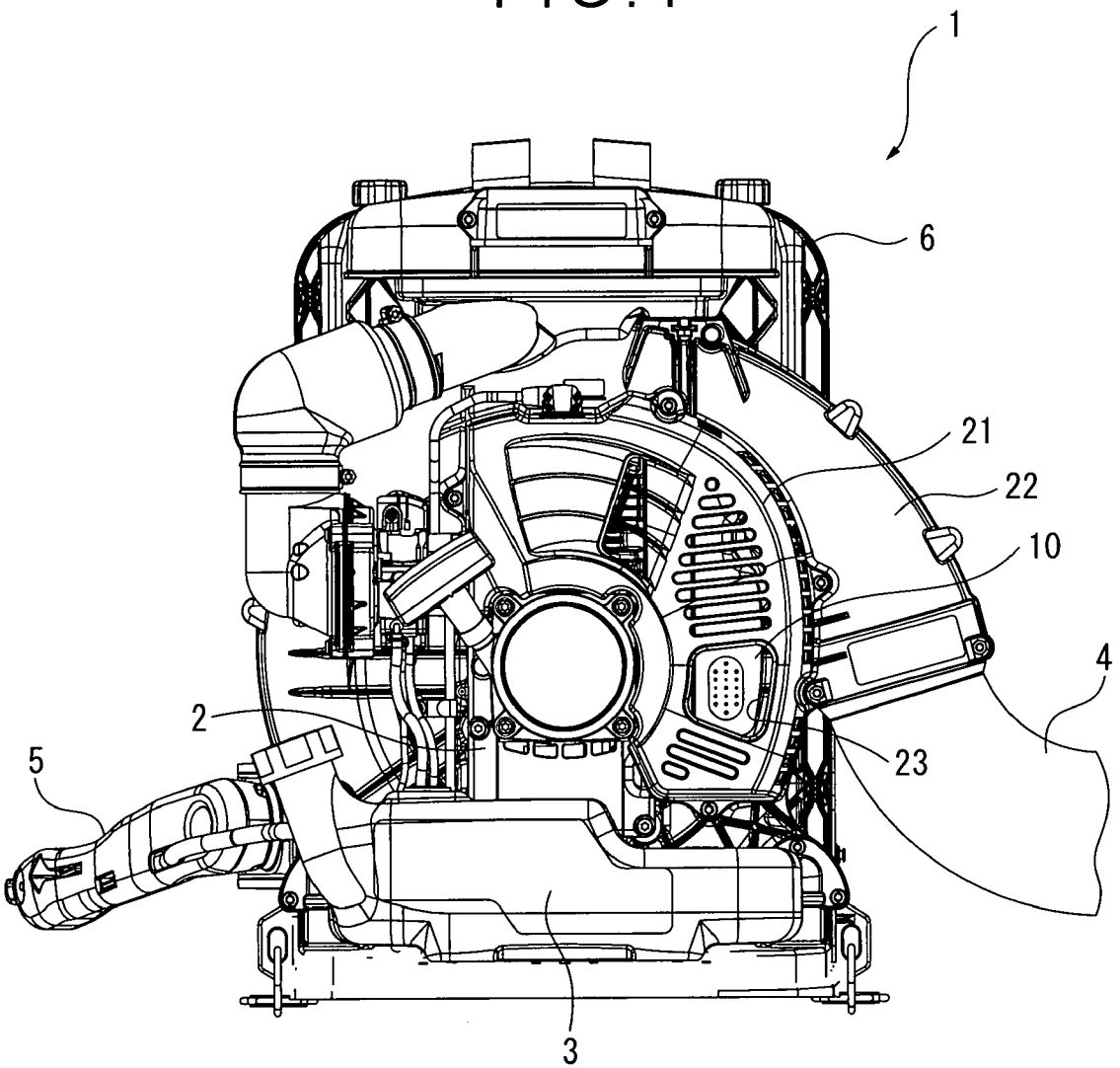
FIG. 1 is an overall view showing a work machine according to an exemplary embodiment of the invention.

FIG. 1 is an overall view showing an engine blower 1 as a work machine according to the exemplary embodiment.

The engine blower 1 is the work machine in which wind power is generated by a blower that drives an engine, and fallen leaves and pruned foliage are swept by blown air. The engine blower 1 includes a body 2 that accommodates the engine and the blower, a fuel tank 3 that retains fuel for the engine, a hose 4 that blows the air generated by the blower, a throttle lever 5 that adjusts an output of the engine, and a shoulder 6 for an operator.

The body 2 is provided with an engine cover 21 that covers the engine and a muffler 10. A portion for accommodating a fan (not shown) and a base end side of the hose 4 are covered with a blower housing 22. The blown air from the blower passes through the blower housing 22 and the hose 4 to be spew out from a tip end (not shown) of the hose 4. The engine cover 21 is provided with an exhaust opening 23 that exhausts the engine exhaust gas from the muffler 10. A temperature of the exhaust gas at a position spaced away from the exhaust opening 23 by a predetermined dimension is regulated to a predetermined value or less.

Figure 2:
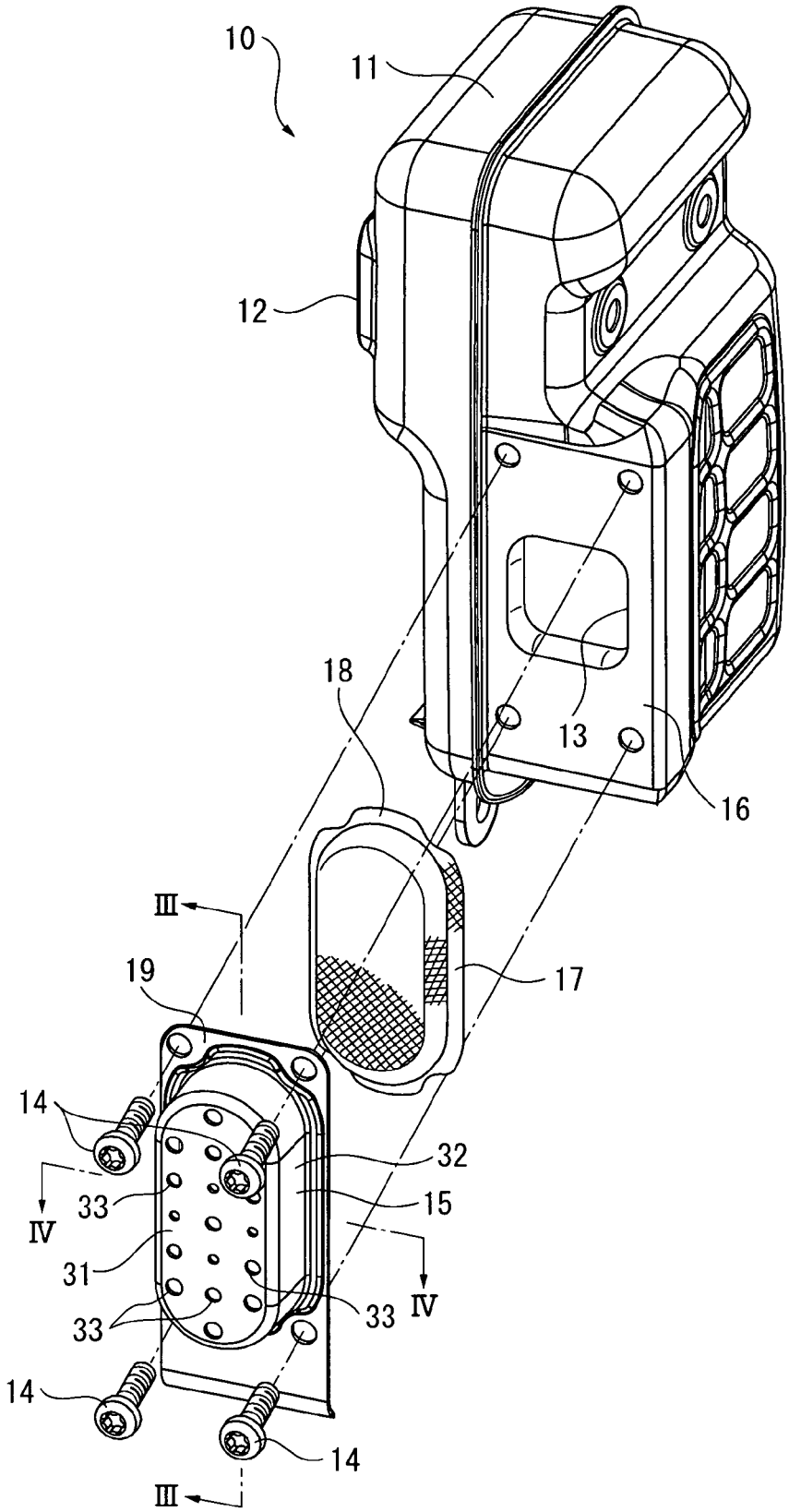
FIG. 2 is a perspective view showing a muffler according to the exemplary embodiment.

FIG. 2 is a perspective view showing the muffler 10 according to the exemplary embodiment.

As shown in FIGS. 1 and 2, the muffler 10 includes a hollow box-shaped muffler body 11 that has an attachment 12 to be bolted to the engine. An inlet (not shown) of the exhaust gas is provided on the attachment 12. The muffler body 11 also has a square exhaust outlet 13. The exhaust outlet 13 is covered with a diffuser 15 attached by screws 14. A position of the diffuser 15 varies depending on a position of the exhaust opening 23 when the muffler is covered with the engine cover 21. The exhaust gas from the exhaust outlet 13 of the muffler 10 passes through the diffuser 15 to be exhausted from the exhaust opening 23 for the shortest distance.

Figure 3:
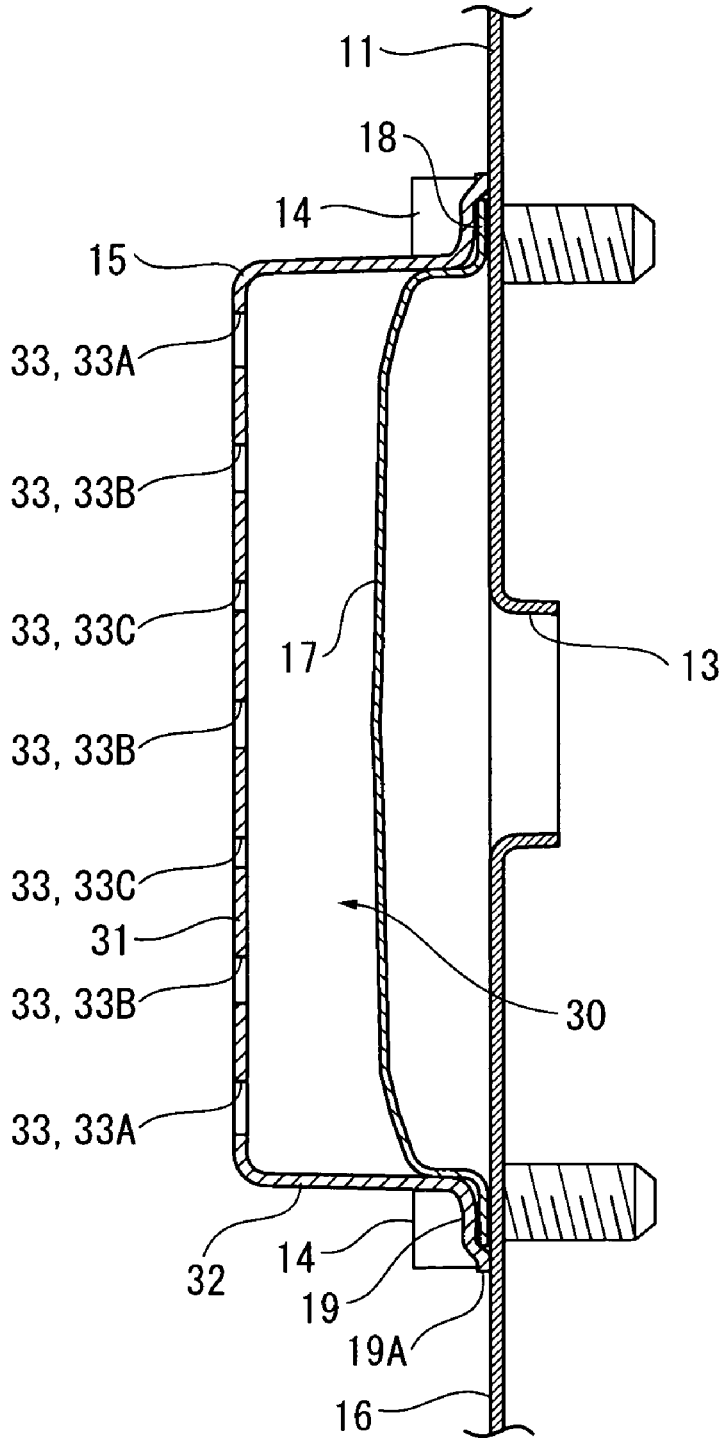
FIG. 3 is a cross sectional view showing a main section of the muffler taken along III-III line in FIG. 2.

As shown in FIG. 3, a reticulated arrestor 17 is interposed between the diffuser 15 and an attachment surface 16 provided with the exhaust outlet 13. The arrestor 17 catches carbons exhausted as a fire spark. Specifically, the arrestor 17 is concavo-convex shaped and includes a sandwiched portion 18. The sandwiched portion 18 is interposed between a flange 19 provided on an outer periphery of the diffuser 15 and the attachment surface 16. The caught carbons are accommodated in the diffuser 15. Alternatively, an arrestor to accommodate the caught carbons toward the exhaust outlet 13 may be used.

The most distinctive diffuser 15 according to the exemplary embodiment will be described below in greater detail.

The diffuser 15 according to the exemplary embodiment exhausts the exhaust gas from the exhaust outlet 13 substantially evenly from a plurality of spots toward the exhaust opening 23, thereby effectively lowering the temperature of the exhaust gas and minimizing an increase in back-pressure to prevent a decrease of the engine output. Specifically, the diffuser 15 is adapted to accommodate the caught carbons of the arrester 17 and provided with a diffusion space 30 to diffuse the exhaust gas from the center to the outer periphery thereof. The diffusion space 30 has an oval exhaust surface 31 that faces the exhaust outlet 13 and an outer peripheral surface 32 that covers the outer periphery of the exhaust surface 31. The diffusion space 30 is projected from the flange 19 toward the exhaust opening 23.

Figure 4:
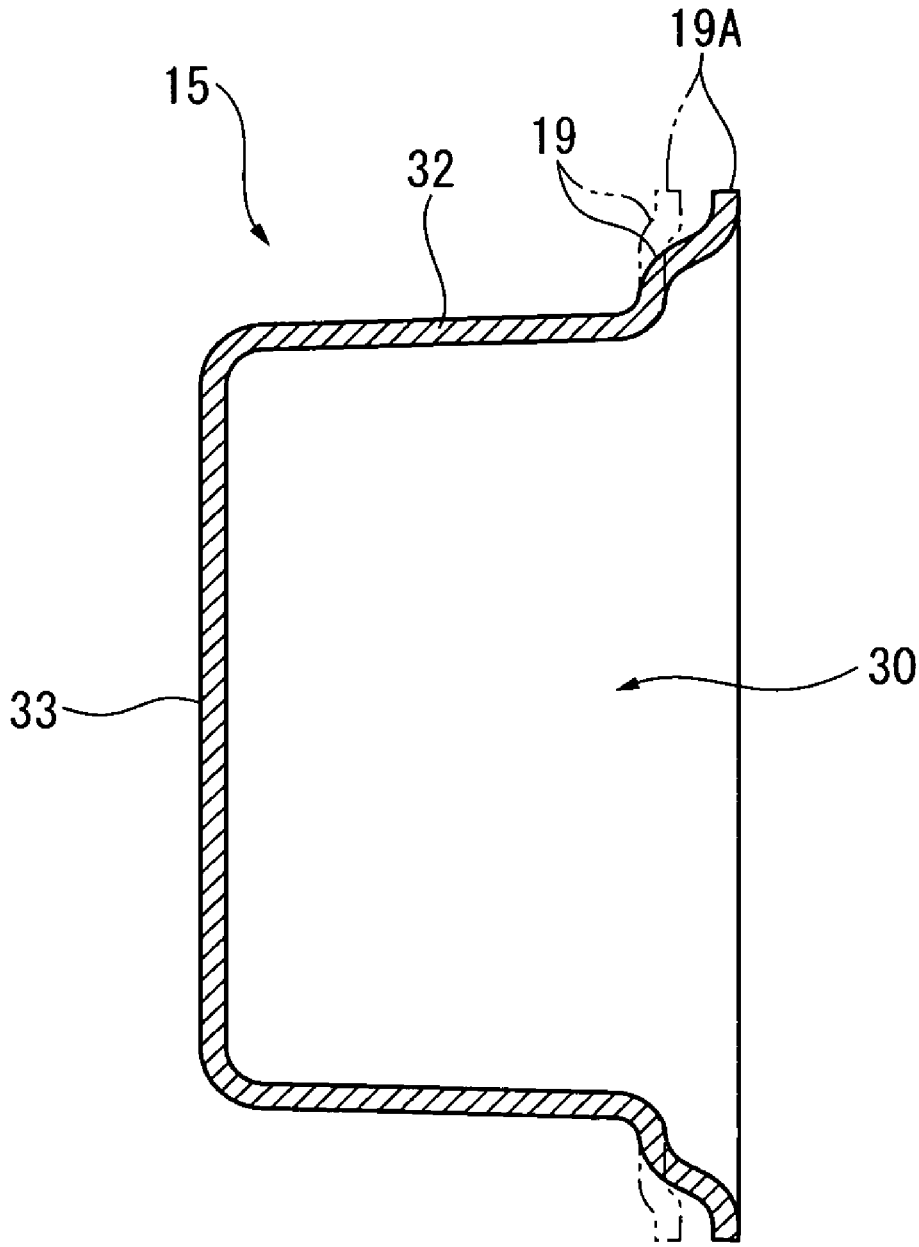
FIG. 4 is a cross sectional view showing a diffuser according to the exemplary embodiment taken along IV-IV line in FIG. 2.

At this time, the flange 19 is provided at an initial position where the flange 19 is inclined toward the attachment surface 16 (FIGS. 2 and 3) at a front side in an attachment direction when the diffuser 15 is not attached to the muffler body 11, as exaggeratingly shown in FIG. 4. When the diffuser 15 is attached to the attachment surface 16, the flange 19 is deformed from the initial position to an attachment position shown as a chain double-dotted line by clamping force of the screws 14 to generate reaction force. Then, a bent portion 19A at a tip end of the flange 19 and the attachment surface 16 are contacted to each other without any space therebetween, which prevents escape of the exhaust gas through the contact portion from the diffusion space 30. At this time, the sandwiched portion 18 of the arrester 17 is interposed between the flange 19 and the attachment surface 16 due to a small step portion formed by the bent portion 19A.

Figure 5:
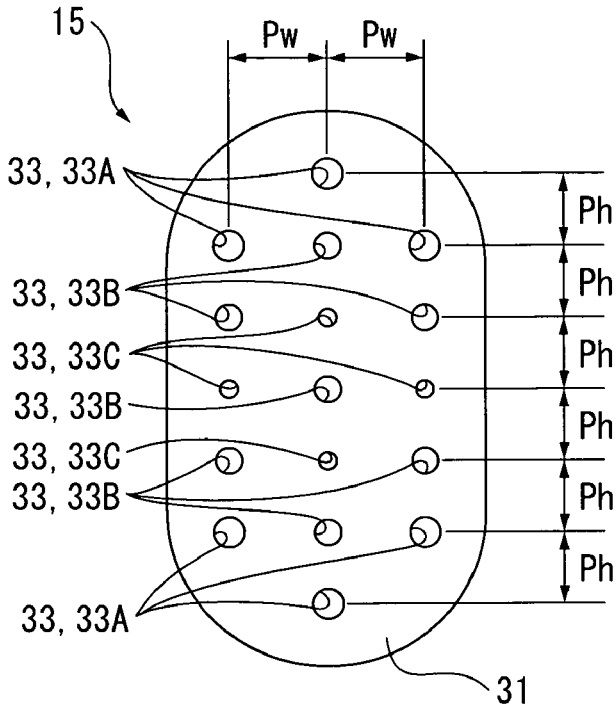
FIG. 5 is a front view showing a concave portion of the diffuser.

A plurality of exhaust circular holes 33 are provided on the exhaust surface 31 of the diffusion space 30. As shown in FIG. 5, three kinds of exhaust circular holes 33A, 33B, and 33C respectively having different diameters are provided as the exhaust circular holes 33. Specifically, the number of the exhaust circular holes 33A having the largest diameter is six, the number of the exhaust circular holes 33B having the second largest diameter is six and the number of the exhaust circular holes 33C having the smallest diameter is four. In the exemplary embodiment, the diameter of the exhaust circular holes 33A is 3.5 mm, the diameter of the exhaust circular holes 33B is 3.0 mm, and the diameter of the exhaust circular holes 33C is 2.0 mm. In addition, each pitch Ph between the adjacent exhaust circular holes in a longitudinal direction (a vertical direction in FIG. 5) is the same and each pitch Pw in a width direction (a horizontal direction in FIG. 5) is also the same.

In the exemplary embodiment, the four exhaust circular holes 33C having the smallest diameter are arranged in the vicinity of the center of the exhaust surface 31, the exhaust circular holes 33B are arranged in the more vicinity of the center of the exhaust surface 31 and around the exhaust circular holes 33C, and the exhaust circular holes 33A having the largest diameter are arranged on both sides of the oval exhaust surface 31 in a longitudinal direction. Accordingly, an opening area of the respective exhaust circular holes 33 is gradually enlarged toward the outer periphery from the center. An opening rate at the outer peripheral side is larger and the exhaust resistance at the outer peripheral side is smaller than those at the center.

Therefore, when the exhaust gas is exhausted from the exhaust outlet 13 of the muffler body 11 positioned corresponding to the substantially center of the exhaust surface 31, the exhaust gas flows toward the outer periphery of the exhaust surface 31 since the exhaust resistance is small on the outer peripheral side. Accordingly, the exhaust gas is adequately diffused to be substantially evenly exhausted from the respective exhaust circular holes 33 so that the temperature of the exhaust gas after being exhausted is effectively lowered. Since a total opening area of all the exhaust circular holes 33 is smaller than an opening area of the exhaust outlet 13, the exhaust resistance is reliably generated in the diffusion space 30 and the exhaust gas is appropriately diffused. Further, the increase of the back-pressure due to the exhaust resistance is suppressed since the appropriate number of the exhaust circular holes 33 is provided, whereby the output of the engine is prevented from being severely decreased.

Figure 6:
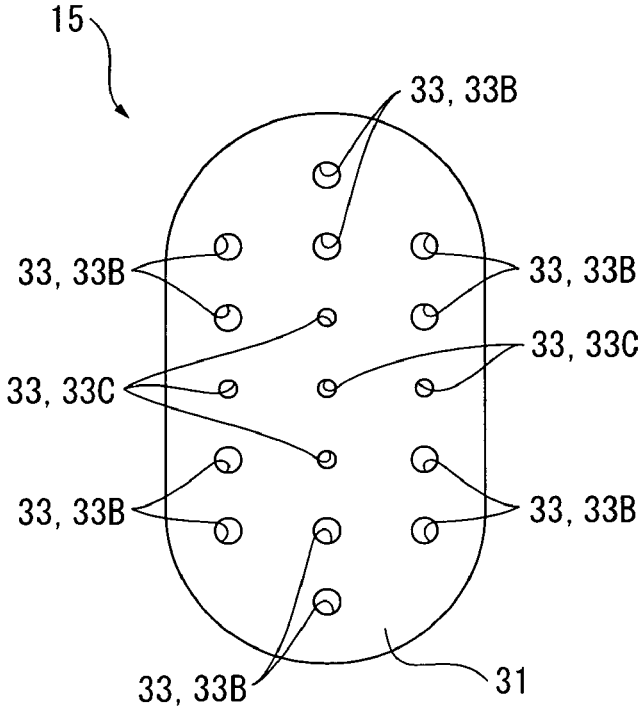
FIG. 6 is a front view showing a first modification of the invention.

FIG. 6 shows the diffuser 15 having two kinds of the exhaust circular holes 33B and 33C according to a first modification of the invention. According to this modification, the five exhaust circular holes 33C having a small diameter are arranged in the vicinity of the center, the twelve exhaust circular holes 33B having a large diameter are arranged adjacent to the outer periphery above and below the exhaust circular holes 33C. The exhaust resistance is gradually reduced toward the outer periphery from the center. The diameter of the respective exhaust circular holes 33B and 33C, the total number of the exhaust circular holes 33 and other arrangements are the same as those of the exemplary embodiment.

According to the first modification, the exhaust circular holes 33A having the largest diameter are not used unlike the exemplary embodiment. Therefore, a total opening area of the exhaust circular holes 33 is smaller than that of the exemplary embodiment. Thus, the exhaust resistance is increased so that the exhaust gas is effectively diffused in the diffusion space 30 and the temperature of the exhaust gas after being exhausted from the exhaust opening 23 of the engine cover 21 is lowered. On the other hand, the exhaust resistance and the back-pressure are increased in the diffusion space 30 so that the output of the engine is slightly decreased. Although there are differences between the exemplary embodiment and the first modification, the first modification can offer substantially the same advantages as those of the exemplary embodiment and is sufficiently applicable.

Figure 7:
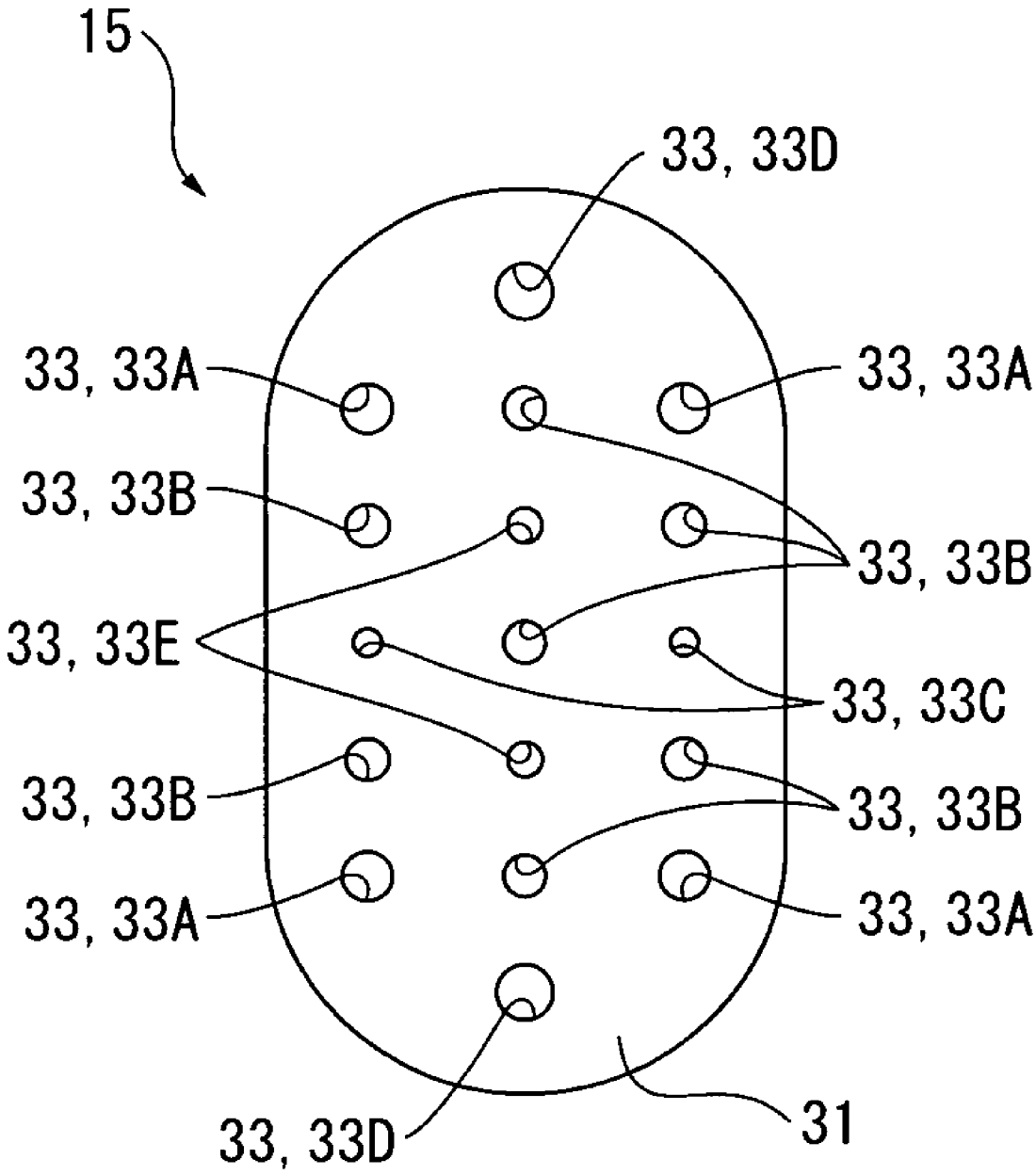
FIG. 7 is a front view showing a second modification of the invention.

FIG. 7 shows five kinds of the exhaust circular holes 33A, 33B, 33C, 33D and 33E according to a second modification of the invention. The diameter of the exhaust circular holes 33D is 4 mm, which is larger than that of the exhaust circular holes 33A. The exhaust circular holes 33D are arranged on both sides adjacent to the most outer peripheral sides of the exhaust surface 31 in a longitudinal direction. The diameter of the exhaust circular holes 33E is between the diameters of the exhaust circular holes 33B and 33C. In this modification, the diameter of the exhaust circular holes 33E is 2.5 mm. The two exhaust circular holes 33E are provided instead of the exhaust circular holes 33C of the exemplary embodiment. Accordingly, the number of the exhaust circular holes 33A and the number of the exhaust circular holes 33C are respectively smaller by two than those of the exemplary embodiment. Other arrangements are the same as those of the exemplary embodiment.

The exhaust circular holes 33D and 33E respectively having a larger diameter as compared to the exhaust circular holes of the exemplary embodiment are used in this modification. Accordingly, a total opening area of the exhaust circular holes 33 is larger than that of the exemplary embodiment. Thus, the exhaust resistance is reduced so that the diffusion performance of the exhaust gas is slightly reduced in the diffusion space 30 and the temperature of the exhaust gas after being exhausted from the exhaust opening 23 slightly rises. On the other hand, the exhaust resistance and therefore the back-pressure are reduced so that the output performance of the engine is slightly enhanced. Although there are differences between the second modification and the exemplary embodiment, the second modification can offer substantially the same advantages as those of the exemplary embodiment and is sufficiently practical.

The invention is not limited to the exemplary embodiment and the first and second modifications described above, but includes other arrangements as long as an object of the invention can be achieved, which includes the following modifications.

For example, the exhaust holes according to the invention are not limited to circular holes, and may have any shapes such as elongated holes and angular holes.

According to the invention, it is sufficient that the exhaust holes are formed such that the opening rate is gradually increased toward the outer periphery from a portion corresponding to the exhaust outlet of the muffler body. For example, a small number of the exhaust holes may be roughly arranged at the center and a great number of the exhaust holes may be densely arranged on the outer peripheral side. In other words, the exhaust holes may be arranged in any manner as long as the respective pitches Ph and Pw at the center are different from those on the outer peripheral side.

Although the best arrangement and the like for carrying out the invention have been disclosed above, the invention is not limited thereto. In other words, while the invention has been particularly illustrated and described with reference to the specific embodiment, those skilled in the art can modify the above-described shapes, quantities and other details without departing from the spirit and the scope of the invention.

Hence, the above-disclosed shapes, quantities and the like are merely described for easy understanding of the invention, so that the invention is not limited thereto. The invention shall include a description using names of components without a part or all of the limitation on the shapes, quantities and the like.

The invention claimed is:

1. A muffler, comprising:

a muffler body adapted to be attached to an engine and receive exhaust gas from the engine, the muffler body including an exhaust outlet through which exhaust gas received from the engine flows outward; and a diffuser that covers the exhaust outlet of exhaust gas provided on the muffler body such that the exhaust gas passes into the diffuser, the diffuser being arranged to lower a temperature of the exhaust gas as the exhaust gas passes therethrough, wherein the diffuser includes a diffusion space to diffuse the exhaust gas passing therethrough, and an exhaust surface on which a plurality of exhaust holes for exhausting the diffused exhaust gas are formed, the exhaust surface facing the exhaust outlet, and wherein an opening rate provided by the exhaust holes of the exhaust surface is gradually increased toward an outer periphery of the exhaust surface from a portion of the exhaust surface opposite the exhaust outlet.

2. The muffler according to claim 1, wherein a total opening area of the exhaust holes is smaller than an opening area of the exhaust outlet.

3. The muffler according to claim 1, wherein:

the plurality of exhaust holes are provided as a plurality of kinds of exhaust holes respectively having a different opening area, some of the plurality of exhaust holes having small opening areas are arranged on the exhaust surface adjacent to the portion opposite the exhaust outlet, and others of the plurality of exhaust holes having large opening areas are arranged adjacent to the outer periphery of the exhaust surface.

4. The muffler according to claim 1, wherein the diffuser is provided with a flange to be attached to the muffler body, and the flange is inclined toward a front side in an attachment direction before the diffuser is attached to the muffler body.

5. A work machine, comprising:

(i) an engine;

(ii) a muffler attached to the engine, the muffler comprising:

a muffler body adapted to be attached to the engine and receive exhaust gas from the engine, the muffler body including an exhaust outlet through which exhaust gas received from the engine flows outward; and a diffuser that covers the exhaust outlet of exhaust gas provided on the muffler body such that the exhaust gas passes into the diffuser, the diffuser being arranged to lower a temperature of the exhaust gas as the exhaust gas passes therethrough, wherein the diffuser includes a diffusion space to diffuse the exhaust gas passing therethrough, and an exhaust surface on which a plurality of exhaust holes for exhausting the diffused exhaust gas are formed, the exhaust surface facing the exhaust outlet, and wherein an opening rate provided by the exhaust holes of the exhaust surface is gradually increased toward an outer periphery of the exhaust surface from a portion of the exhaust surface opposite the exhaust outlet; and (iii) an engine cover that covers the engine and the muffler, wherein the engine cover is provided with an exhaust opening at a position opposite the exhaust outlet of the muffler body to exhaust the exhaust gas to outside of the engine cover.

6. The muffler according to claim 1, wherein the muffler body is arranged to attenuate sound.

7. The muffler according to claim 1, wherein the exhaust holes are constructed and arranged such that the opening rate provided by the exhaust holes results in reduced resistance to flow of the exhaust gas at the outer periphery of the exhaust surface relative to the portion of the exhaust surface opposite the exhaust outlet whereby the exhaust gas is evenly diffused toward the outer periphery of the exhaust surface and evenly exhausted from the exhaust holes.

8. The muffler according to claim 1, wherein the muffler body is hollow and box-shaped.

9. The muffler according to claim 1, further comprising an attachment for attaching the muffler body to the engine.

10. The muffler according to claim 1, wherein the exhaust outlet is square-shaped.

11. The muffler according to claim 1, further comprising an arrestor arranged between the exhaust outlet of the muffler body and the exhaust surface.

12. The muffler according to claim 11, wherein the arrestor is reticulated.

13. The muffler according to claim 11, wherein the diffusion space is arranged between the arrestor and the exhaust surface.

14. The muffler according to claim 1, wherein the diffuser is arranged to diffuse the exhaust gas from a center thereof to an outer periphery thereof.

15. The muffler according to claim 1, wherein the exhaust surface is oval.

16. The muffler according to claim 1, wherein the exhaust holes have only two different diameters.

17. The muffler according to claim 1, wherein the exhaust holes have only three different diameters.

18. The muffler according to claim 1, wherein the exhaust holes have only five different diameters.

19. The muffler according to claim 1, wherein a pitch in a vertical direction between adjacent exhaust holes is the same.

20. The muffler according to claim 1, wherein a pitch in a horizontal direction between adjacent exhaust holes is the same.

* * * * *